United States Patent [19]

Tanaka et al.

[11] 4,389,184

[45] Jun. 21, 1983

[54] COMBUSTION CONTROL APPARATUS

[75] Inventors: Toshio Tanaka, Toride; Sumio Nakagawa, Matudo; Kenzi Toudo, Yanai, all of Japan

[73] Assignee: Hitachi, Ltd., Tokyo, Japan

[21] Appl. No.: 224,289

[22] PCT Filed: Jan. 24, 1980

[86] PCT No.: PCT/JP80/00008

§ 371 Date: Sep. 23, 1980

§ 102(e) Date: Sep. 23, 1980

[87] PCT Pub. No.: WO80/01604

PCT Pub. Date: Aug. 7, 1980

[30] Foreign Application Priority Data

Jan. 24, 1979 [JP] Japan ..... 54/6158

[51] Int. Cl.[3] ..... F23N 5/24

[52] U.S. Cl. ..... 431/15; 431/31; 431/69; 431/73; 431/77

[58] Field of Search ..... 431/69, 15, 16, 31, 431/66, 71, 73, 74, 77; 307/117, 129

[56] References Cited

U.S. PATENT DOCUMENTS

| | | | |
|---|---|---|---|
| 3,324,927 | 6/1967 | Staring | 431/15 |
| 3,715,180 | 2/1973 | Cordell | 431/31 X |
| 3,999,933 | 12/1976 | Murphy | 431/31 X |
| 4,137,035 | 1/1979 | Cade | 431/31 X |
| 4,145,180 | 3/1979 | Bendorf | 431/46 |
| 4,192,641 | 3/1980 | Nakagawa et al. | 431/31 X |
| 4,239,478 | 12/1980 | Tanaka et al. | 431/15 X |
| 4,249,884 | 2/1981 | Cade | 431/31 |

*Primary Examiner*—Samuel Scott
*Assistant Examiner*—Randall L. Green
*Attorney, Agent, or Firm*—Antonelli, Terry & Wands

[57] ABSTRACT

A combustion control apparatus which controls combustion in a combustor which is a heat source of a hot-water boiler or a hot-air heater includes a memory circuit which generates an alarm signal and also a signal for stopping the operation of the apparatus and which maintains the apparatus in the shutdown state, when an abnormal condition such as abnormal heating or ignition failure is sensed. This memory circuit is protected from malfunction due to noise generated from external output units in the combustion control apparatus by a circuit which detects an abnormality signal with timing other than the timing of generation of noise from the external output units, and the output of this circuit is applied as an input to the memory circuit. The detection circuit is arranged to detect the abnormality signal while receiving clock pulses from a timer as its input, and the phase of its detection timing is selected to be out of phase with the noise generation. The detection timing is determined so that it differs from the timing of on-off control for each of the external output units and also from the generating timing of discharge pulses in the ignition unit.

14 Claims, 3 Drawing Figures

COMBUSTION CONTROL APPARATUS

TECHNICAL FIELD

This invention relates to a combustion control apparatus which controls combustion in a combustor which is a heat source of a hot-water boiler or a hot-air heater.

BACKGROUND ART

A combustion control apparatus includes a memory circuit which generates an alarm signal and generates also a signal for stopping the combustion in the apparatus and which maintains its non-combustion state, when an abnormal condition such as abnormal heating, shortage of a medium (water) to be heated or ignition failure is sensed.

However, malfunction of such apparatus has occurred frequently due to the fact that this memory circuit is generally easily affected by noise, which can easily enter this memory circuit. This malfunction is objectionable as it may lead to an interruption of the combustion in the apparatus.

In the combustion control apparatus, noise is generated due to on-off operation of electromagnetic relays for various external output units driven by combustion control output signals from a combustion control circuit in the apparatus and also due to on-off operation of a fuel supply unit, a combustion blower and an ignition unit driven by the relays above described. Such noise is applied to the memory circuit through an input circuit and gives rise to a source of malfunction of the apparatus.

DISCLOSURE OF THE INVENTION

It is an object of the present invention to prevent the memory circuit from causing a malfunction by being affected by noise generated from the external output units. More precisely, the present invention comprises a circuit which detects an abnormality signal with timing other than the timing of generation of noise from the external output units, and the output of this circuit is applied as an input to the memory circuit. According to the present invention, malfunction due to noise from the external output units can be prevented in spite of a simple structure.

BEST MODE FOR CARRYING OUT THE INVENTION

Figure 1:
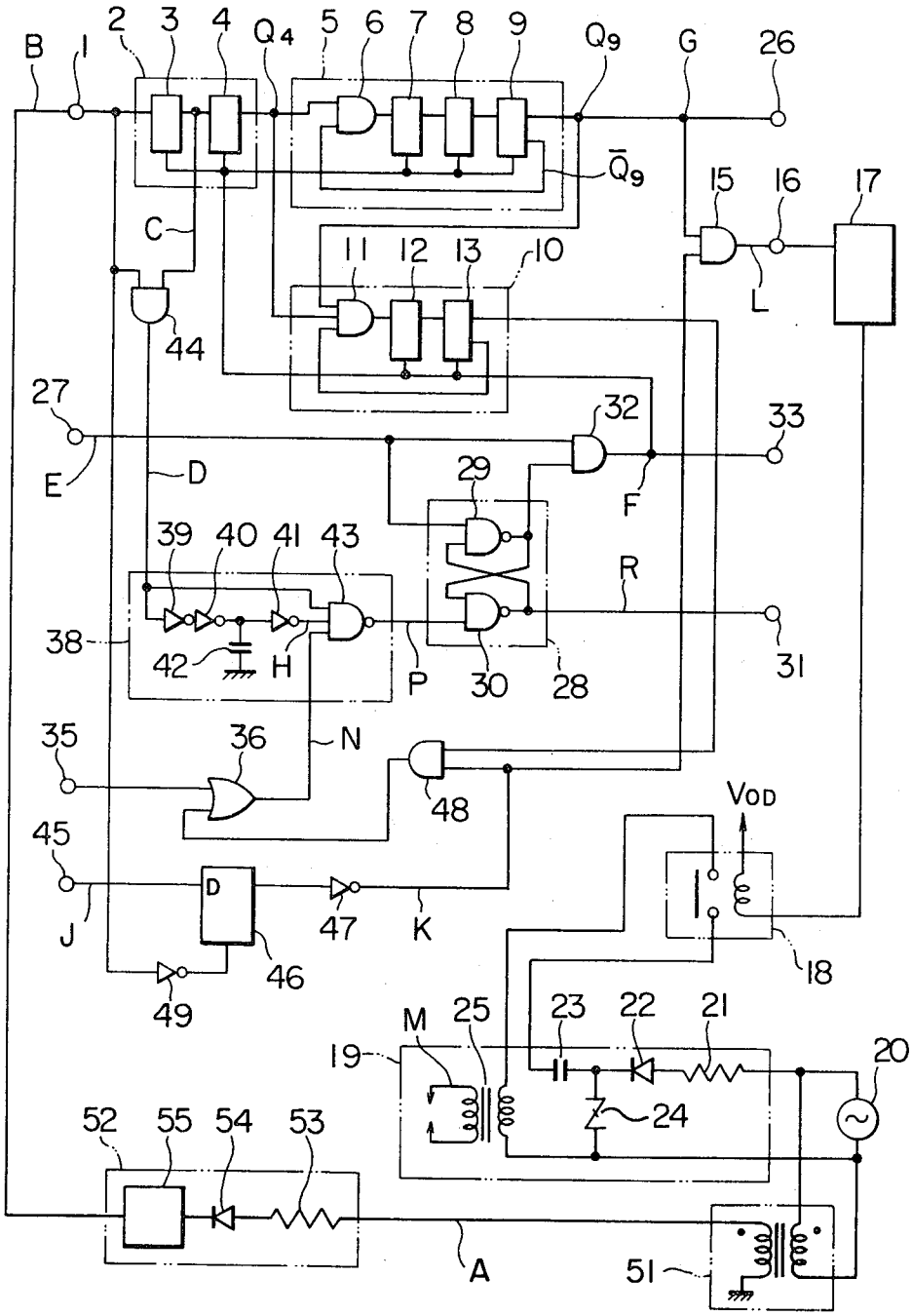
FIG. 1 is a circuit diagram of an embodiment of the combustion control apparatus of the present invention.

The present invention will now be described with reference to an embodiment shown in FIG. 1. In order to simplify the designation of and facilitate the understanding of various input signal terminals and output signal terminals shown in the figure, the word "terminal" may be omitted from them, and they may be designated by suffixing the reference numeral to the name of the signal. For example, "reference clock pulse input terminal 1" may be designated as "reference clock pulse 1". Further, a signal at each of the terminals has a digital value of "0" or "1".

The illustrated embodiment is of a type in which the igniting operation is performed after pre-purging, and the operation of the igniter is stopped when ignition is attained.

Reference numeral 1 designates a reference clock pulse input terminal, and 2 designates a reference timer which is composed of counters 3 and 4. Reference numeral 5 designates a timer for timing a pre-purge period (which will be referred to hereinafter as a pre-purge timer), and this timer 5 starts its timing operation after the reference timer 2 has operated. The pre-purge timer 5 is composed of an AND gate 6 and counters 7, 8 and 9. Reference numeral 10 designates a timer for timing a safety period (which will be referred to hereinafter as a safety timer), and this timer 10 starts its timing operation after the pre-purge timer 5 has operated. The safety timer 10 is composed of an AND gate 11 and counters 12 and 13. The counters in these timers 2, 5 and 10 are inverted by a negative edge.

Reference numeral 15 designates an AND gate, 16 an ignition unit drive terminal, 17 an output circuit, 18 an electromagnetic relay, 19 an ignition unit, and 20 a commercial AC power source. The unit 19 is composed of a resistor 21, a diode 22, a condenser 23, a Sydac 24 and an ignition transformer 25 in a manner well known in the art.

Reference numeral 26 designates a fuel supply unit drive terminal which controls a fuel supply unit via an output circuit and an electromagnetic relay.

Reference numeral 27 designates a terminal in which a temperature signal is applied from a temperature sensing circuit, and the signal is "1" at low temperatures.

Reference numeral 28 designates a memory circuit which operates in response to an abnormality signal and is in the form of an RS flip-flop (which will be referred to hereinafter as RSFF) composed of NAND gates 29 and 30.

Reference numeral 31 designates an alarm signal terminal connected to an external alarm circuit. Reference numeral 32 designates an AND gate, and 33 designates a combustion blower drive terminal which controls a combustion blower via an output circuit and an electromagnetic relay.

Reference numeral 35 designates an input terminal to which an abnormality signal is applied from a circuit which senses an abnormal condition such as an unusual temperature rise or shortage of water in a hot-water boiler, and the signal is "0" in the normal condition. Reference numeral 36 designates an OR gate to which the abnormality signal 35 and a misignition signal are applied, and 38 designates an abnormality signal detecting circuit which comprises a differentiation circuit generating a strobing pulse and a circuit for detecting the strobing pulse and the abnormality signal. This circuit 38 is composed of inverters 39, 40, 41, a capacitance 42 and a NAND gate 43. The clock used for the detection purpose is derived from an AND gate 44.

Reference numeral 45 designates an input terminal to which a flame signal is applied from a flame sensing circuit, and the signal is "0" in the absence of flames. 46 designates a D flip-flop (which will be referred to hereinafter as a DFF) operating as a circuit for detecting the flame signal 45, and this circuit 46 detects the flame signal 45 at a phase different from that of the abnormality signal detecting circuit 38. The DFF 46 is inverted by a positive edge. Reference numeral 47 designates an inverter, and 48 designates an AND gate. Reference numeral 49 designates an inverter.

Reference numeral 51 designates a power transformer, and 52 designates a known reference clock pulse generating circuit which is composed of a resistor 53, a diode 54 and a comparator 55. The phase of the clock pulses used for detecting the abnormality signal is selected to differ from that of the discharge pulses used for ignition.

Figure 2:
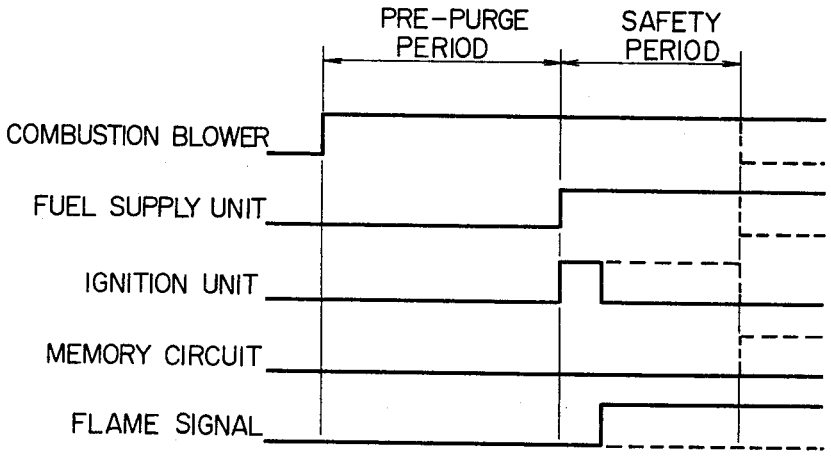
FIG. 2 illustrates operation of various units in the combustion control apparatus.

The operation of the apparatus having such a construction will be described. At first, its general operation will be described, as well as referring to FIG. 2. When now the temperature of the medium to be heated drops and the temperature signal 27 is turned "1" from "0" to the starting operation, output of the NAND gate 29 is turned to "1" to turn the AND gate 32 to "1", and the terminal 33 turns on the blower drive. The combustion blower starts its operation to start pre-purging. At the same time, the individual timers 2, 5 and 10 are released from their reset state, and the reference timer 2 effects its frequency dividing operation on the reference clock pulses 1 generated from the reference clock pulse generating circuit 52. The pre-purge period starts at this time. As $Q_4$ is turned to "1", the pre-purge timer 5 starts its operation. Upon lapse of the pre-purged period, the output $Q_9$ generates "1" to provide an igniting operation starting signal via AND gate 15. The terminal 26 turns on the electromagnetic relay which acts to open the fuel supply unit. At the same time, the output of AND gate 15 is turned to "1", and the terminal 16 turns on the electromagnetic relay 18 which drives the ignition unit 19. Discharge pulses appear from the ignition transformer 25 to start the igniting operation. The operation of the pre-purge timer 5 is stopped by the output $\overline{Q_9}$.

At the same time, the output $Q_9$ is applied to the AND gate 11 so that the safety timer 10 starts to time the safety period. When ignition is attained by the aforementioned igniting operation and the flame signal "1" is applied from the terminal 45 before the output $Q_{10}$ is turned into "1", the output of DFF 46 is turned to "1" to turn the output of inverter 47 to "0" and also to turn the output of AND gate 15 to "0". The electromagnetic relay 18 is turned off to stop the operation of the ignition unit 19.

The output of DFF 46 is "0" if the ignition is not attained within the safety period. Upon termination of the safety period, the output of AND gate 48 is turned to "1" to turn the output of OR gate 36 to "1" and to turn the output of the detecting circuit 38 to "0". The memory circuit or RSFF 28 operates as shown by the broken curve in FIG. 2, and the output of NAND gate 29 is now turned to "0" to turn the output AND gate 32 to "0". The timers 2, 5 and 10 are reset, and the individual terminal 16, 26 and 33 are turned to "0" to stop the operation of all the external output units. The alarm signal 31 is turned to "1" to inform the outside of occurrence of an abnormal condition.

The operation is also similarly stopped when the abnormality signal is applied from the terminal 35.

When the temperature signal 27 of "0" instructing stoppage of the operation is applied, the terminals 26 and 33 are turned to "0" to turn off the electromagnetic relays thereby stopping the operation.

The operation of the circuit 38 will next be described with reference to FIG. 3. The waveforms A to R are those appearing at the points A to R respectively in FIG. 1.

The output $Q_3$ of the counter 3 is "0" when the temperature signal 27 is "0". Consequently, the output of AND gate 44 is "0", and the output of NAND gate 43 is "1" regardless of the output of the OR gate 36. Thus, the abnormality signal detecting circuit 38 does not operate during the stoppage of operation of the apparatus.

The counter 3 operates as the temperature signal 27 is turned to "1", that is, when the operation starting instruction is applied. The differentiation circuit in the detecting circuit 38 generates a strobing pulse in response to a positive edge of a clock pulse D appearing at the output of the AND gate 44 so as to permit its detecting operation. The generating timing of this strobing pulse corresponds to the positive edge of the reference clock pulse B.

When no abnormality signal is applied to the terminal 35 or when no misignition signal is applied from the AND gate 48, the output of the OR gate 36 is "0", and the output of the NAND gate 43 continues to be "1".

If an abnormality signal or the misignition signal of "1" is applied from the terminal 35 or from the output of AND gate 48, the OR gate 36 is inverted, and the output of NAND gate 43 is inverted in response to the strobing-pulse generating positive edge of the clock pulse D appearing at the output of the AND gate 44, as shown by the broken curves. The output of RSFF 28 is inverted, and "1" appears now at the output of the NAND gate 30, while "0" appears at the output of the NAND gate 29 so as to stop the operation of the apparatus and to output information of the occurrence of an abnormal condition.

Generation and removal of noise will next be described. Noise is generated at the following times: the turning-on time of the blower, the turning-on time of the ignition unit 19 and fuel supply unit, the turning-off time of the ignition unit 19, the turning-off time of the blower and fuel supply unit, and the generating timing of the discharge pulse from the ignition transformer 25. This noise will now be explained.

Figure 3:
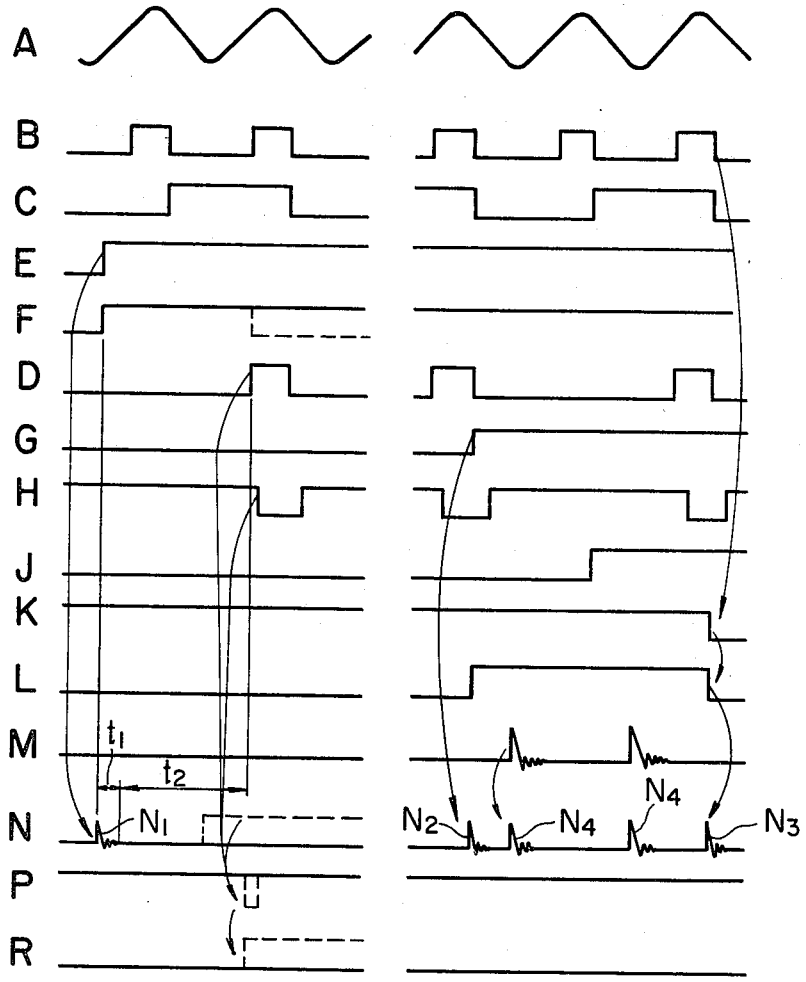
FIG. 3 shows operating waveforms at various points in FIG. 1.

When the temperature signal E is turned to "1" to instruct starting of the operation, the terminal 33 is immediately turned to "1" as shown in FIG. 3, and the electromagnetic relay for the blower is turned on to generate a noise $N_1$ at the turning-on time of the blower. No strobing pulse is generated at this time since the output of the counter 3 acting to generate the strobing pulse used for detecting an abnormality signal is "0" at this time. Upon lapse of $t_2$ after the end of the duration $t_1$ of the noise $N_1$, the strobing pulse appears in response to the positive edge of the clock pulse D. Therefore, the influence of this noise $N_1$ can be obviated.

In the next place, a noise $N_2$ is generated at the turning-on time of the ignition unit 19 and fuel supply unit, and at this time, the pre-purge period has just terminated, and "1" has appeared at the output $Q_9$. The appearing timing of this output corresponds to the negative edge of the reference clock pulse B. The influence of this noise $N_2$ can therefore be eliminated.

In the next place, the timing-off time of the ignition unit 19 will be described. When the ignition is attained, and the frame signal J is turned to "1", the output of DFF 46 is inverted to "1" by the inverter 49 in response to the negative edge of the reference clock pulse B, and the output of AND gate 15 is turned to "0" to turn off the electromagnetic relay 18 for the ignition unit 19. This noise $N_3$ is generated in response to the negative edge of the reference clock pulse B, and the influence of this noise can therefore be eliminated.

In the next place, the blower and fuel supply unit are turned off when the temperature signal applied from the terminal 27 is turned to "0". In this case, the counter 3 is reset, and the abnormality signal detecting circuit 38 is not in operation. Therefore, the circuit 38 is not affected by a noise generated due to this off condition.

In the last place, a noise $N_4$ due to a discharge pulse can also be removed since the phase of the discharge pulse generated from the ignition transformer 25 during the igniting operation is also shifted from that of the strobing pulse.

Thus, it is possible to eliminate the influence of noise generation with the on-off operations of the individual electromagnetic relays for the blower, ignition unit 19 and fuel supply unit, the influence of noise generation with the on-off operations of the individual units, and the influence of discharge pulses.

With regard to other noise, its influence can also be eliminated unless it is synchronous.

In the aforementioned embodiment, the detecting clock pulse supplied to the abnormality signal detecting circuit 38 is derived from the AND gate 44 which receives the reference clock pulses 1 and the output of the counter 3 as its inputs. Therefore, the time interval between the time of noise generation and the time of detection can be increased compared with the case in which the output of the counter 3 is used as the detecting clock pulse, while the period of detection is the same. The master slave system provides a large margin against noise when the detecting clock pulse is supplied from the counter 3.

An AND gate may be provided to receive the reference clock pulses 1 and the temperature signal 27 as its inputs, and its output may be applied to the counter 3 and may also be applied as the detecting clock pulse. However, this is undesirable in that a strobing pulse may be generated immediately after the reset condition is released.

In the case of obtaining the detecting clock pulse 1 on the basis of only the reference clock pulse "1" it is impossible to completely prevent noise generation at the on-off time of the blower and at the off-time of the fuel supply unit. Further, the margin against noise is small.

In the aforementioned embodiment, the ignition unit is deenergized by the flame signal 45. However, it may be deenergized in response to, for example, the termination of the safety period timed by the safety timer 10. In this case, there is no influence of noise since the ignition unit is deenergized in response to the negative edge of the reference clock pulse 1. The same applies also to the case in which, when the ignition has been attained, the ignition unit is kept operated for a predetermined period of time by the timer even after the lapse of the safety period.

In the type in which the sequence returns to the prepurging operation and the re-igniting operation is then carried out in the event of flame extinction in the course of combustion, the influence of the noise generated at the turning-off time of the fuel supply unit can be eliminated since the timer is in the reset state.

Besides the illustrated construction, the abnormality signal detecting circuit 38 may be constructed by the use of a D flip-flop like that used in the flame signal detecting circuit. It can also be obtained by any other construction.

The DFF 46 in the flame signal detecting circuit may be replaced by any other construction.

In the aforementioned embodiment, the timer part is composed of three timers 2, 5 and 10. The arrangement will be similar to that above described even when the timer part is composed of a single timer or more timers.

In the aforementioned embodiment, the timer does not perform its frequency dividing operation when the apparatus is shut down. However, the present invention can be applied to the type of apparatus in which the timer is ready for the frequency division operation, and when the temperature signal is inverted to operation from the shutdown, a pulse is applied for reset and set of the timer so that the timer starts its frequency dividing operation again. However, the abnormality signal detecting circuit 38 is operable in this case. Therefore, unless the RSFF 28 is designed to be reset during shutdown, this RSFF 28 will undesirably be triggered by a noise during the shutdown. The abnormality signal detecting circuit or the memory circuit may be made inoperative for protection from noise during the shutdown operation.

It will be understood from the foregoing description that the present invention comprises a memory circuit which is adapted to operate with timing other than the generation of timing of noise generated from external output units, so that the memory circuit may not be affected by noise.

We claim:

1. A combustion control apparatus comprising:

timer means including a reference clock pulse generator and a counter for producing first and second timing signals upon counting predetermined first and second numbers of reference clock pulses, respectively, said second number being larger than said first number;

means including an OR gate for producing an output signal in response to either one of a first malfunction signal which is produced when a flame signal indicative of ignition of fuel is not produced before generation of said second timing signal and a second malfunction signal indicative of an abnormality of one or more external devices associated with the apparatus;

means including an R-S flip-flop for producing, when it is rendered operative, a set signal in response to said output signal of said OR gate;

detection means for producing a detecting signal in response to a second clock pulse produced at the timing corresponding to a selected one of the leading and trailing edges of the reference clock pulse;

means for rendering said R-S flip-flop operative under the AND condition of said detecting signal and said output signal of said OR gate; and control means for producing output signals for controlling operation of the external devices, said output signals being produced at the timing corresponding to the other of the leading and trailing edges of the reference clock pulse.

2. A combustion control apparatus according to claim 1, futher comprising means responsive to the set signal of said R-S flip-flop to interrupt the generation of said second clock pulse.

3. A combustion control apparatus according to claim 2, wherein the operation of said timer means is stopped in response to the set signal of said R-S flip-flop and the output of said timer is applied to said R-S flip-flop for said second clock pulse.

4. A combustion control apparatus according to claim 3, wherein said second clock pulse is produced under the AND condition of one of the reference clock pulses and an output signal of said timer means counter.

5. A combustion control apparatus according to claim 1, further comprising means for detecting the presence or absence of said flame signal at a timing of the other edge of the reference clock pulse.

6. A combustion control apparatus according to claim 5, wherein the detection of said flame signal is carried out at a frequency higher than the frequency of application of said second clock pulse to said R-S flip-flop.

7. A combustion control apparatus according to claim 1, wherein said control means includes means for generating a third signal for driving a combustion blower and starting the operation of said timer counter, in response to a predetermined operation-starting command signal, means for generating a fourth signal for driving a fuel supply unit and an ignition unit in response to said first timing signal, means for generating a fifth signal for stopping the operation of said ignition unit in response to said flame signal and means for generating a sixth signal for stopping at least said fuel supply unit in response to the set signal of said R-S flip-flop.

8. A combustion control apparatus according to claim 1, wherein said reference clock pulse is produced from the output of an AC power source and the ignition unit includes means for producing a discharge spark from said AC output in synchronism with the frequency of said AC output, but out of phase of said reference clock pulse.

9. A combustion control apparatus comprising:

means for generating reference clock pulses at a predetermined frequency;

timer means enabled by a temperature signal and responsive to said reference clock pulses for generating a first timing signal, an ignition signal a first predetermined time after said first timing signal and a second timing signal a second predetermined time after said ignition signal;

means for producing a fault signal in response to either one of a first malfunction signal produced when a flame signal indicative of ignition of fuel is not received prior to generation of said second timing signal and a second malfunction signal indicative of an abnormality in one or more external devices;

means responsive to a fault signal for generating an alarm signal and for inhibiting said temperature signal so as to disable said timer means; and fault detector means connected to said fault signal producing means and responsive to simultaneous receipt of said first timing signal and a reference clock pulse for gating said fault signal to said alarm signal generating means.

10. A combustion control apparatus according to claim 9, wherein said timer means includes means for generating said ignition signal in coincidence with the trailing edge of a reference clock signal.

11. A combustion control apparatus according to claim 9, further including flame detector means responsive to an applied flame indicating signal and the trailing edge of a reference clock pulse for inhibiting said ignition signal.

12. A combustion control apparatus according to claim 9, further including an ignition unit responsive to said ignition signal for generating a succession of ignition discharges and means for controlling said generation of ignition discharges so that they are shifted in phase from the operation of said fault detector means.

13. A combustion control apparatus according to claim 9, wherein said fault detector means includes means for gating said fault signal to said alarm signal generating means in coincidence with the leading edge of a reference clock pulse.

14. A combustion control apparatus according to claim 9, wherein said timer means includes reference timing means for generating said first timing signal, prepurge timing means for generating said ignition signal and safety timing means for generating said second timing signal.

* * * * *